US011890721B2

(12) United States Patent
Yamanaka et al.

(10) Patent No.: US 11,890,721 B2
(45) Date of Patent: Feb. 6, 2024

(54) SCREW ROTOR PROCESSING METHOD AND SCREW ROTOR LEAD CORRECTION CALCULATION DEVICE

(71) Applicant: Hitachi-Johnson Controls Air Conditioning, Inc., Tokyo (JP)

(72) Inventors: Toshio Yamanaka, Tokyo (JP); Koji Utsumi, Tokyo (JP); Hisashi Aoki, Tokyo (JP); Yoshiyuki Yamada, Tokyo (JP); Hidetaro Kayanuma, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 1279 days.

(21) Appl. No.: 16/434,190

(22) Filed: Jun. 7, 2019

(65) Prior Publication Data

US 2019/0283207 A1 Sep. 19, 2019

Related U.S. Application Data

(63) Continuation of application No. PCT/JP2017/040050, filed on Nov. 7, 2017.

(51) Int. Cl.
*B24B 49/04* (2006.01)
*B24B 5/16* (2006.01)
(Continued)

(52) U.S. Cl.
CPC ..... *B24B 49/04* (2013.01); *B24B 5/16* (2013.01); *F04C 2/00* (2013.01); *F04C 18/16* (2013.01); *F04C 29/06* (2013.01)

(58) Field of Classification Search
CPC ..... B24B 49/04; B24B 5/16; B24B 19/022; B24B 53/075; B24B 53/085; B24B 41/02;
(Continued)

(56) References Cited

U.S. PATENT DOCUMENTS

2007/0240318 A1* 10/2007 Matsumiya ..... G01B 7/284 33/199 R
2012/0184183 A1* 7/2012 Yanase ..... G05B 19/186 451/47
2016/0107291 A1* 4/2016 Ozaki ..... B24B 53/075 451/47

FOREIGN PATENT DOCUMENTS

JP 06-159271 A 6/1994
JP 2007-262936 A 10/2007
(Continued)

OTHER PUBLICATIONS

International Search Report of PCT/JP2017/040050 dated Feb. 6, 2018.

*Primary Examiner* — Joel D Crandall
*Assistant Examiner* — Michael A Gump
(74) *Attorney, Agent, or Firm* — Mattingly & Malur, PC

(57) ABSTRACT

A screw rotor lead correction calculation device includes an initial data input section configured to input an error as a distance with respect to a reference lead at each axial position of a rotor groove portion of a screw rotor, and a processing machine input correction amount/position output section configured to compute and output, based on the error as the distance input to the initial data input section, a lead correction amount with respect to the reference lead and a lead correction starting position as an axial position for starting lead correction. With this configuration, correction data for obtaining a screw rotor with a high-accuracy lead can be obtained from a lead error with respect to a reference lead in a screw rotor obtained by ground finish of the material of the screw rotor.

5 Claims, 7 Drawing Sheets

(51) Int. Cl.
*F04C 29/06* (2006.01)
*F04C 18/16* (2006.01)
*F04C 2/00* (2006.01)

(58) Field of Classification Search
CPC ..... B24B 41/005; B24B 47/22; F04C 18/16; F04C 18/084; F04C 29/00; F04C 29/06; F04C 2230/10; F04C 2230/80; F04C 2240/20; B23F 23/1225; B23F 5/02; B23F 5/04; B23F 19/00; B23F 1/02
USPC ..... 451/5
See application file for complete search history.

(56) References Cited

FOREIGN PATENT DOCUMENTS

| | | | | |
|---|---|---|---|---|
| JP | 2016-14369 | A | | 1/2016 |
| JP | 2016014369 | A | * | 1/2016 |

* cited by examiner

SCREW ROTOR PROCESSING METHOD AND SCREW ROTOR LEAD CORRECTION CALCULATION DEVICE

CROSS-REFERENCE TO RELATED APPLICATION

The present application is a continuation application of International Application No. PCT/JP2017/040050, filed on Nov. 7, 2017, the contents of which is incorporated herein by reference in its entirety.

TECHNICAL FIELD

The present invention relates to the method for processing a screw rotor used for a screw compressor etc. and a screw rotor lead correction calculation device.

BACKGROUND ART

A screw compressor using a screw rotor including a spiral member has been known as one form of a compressor used for a refrigeration device or an air compressor. The screw compressor is configured such that a pair of screw rotors engages with each other to form a compression chamber and these screw rotors are rotated in opposite directions relative to each other to suck gas fluid such as refrigerant or air and decrease the volume of the gas fluid to compress the gas fluid.

The method for performing ground finish for a spiral rotor groove portion (a tooth groove portion) formed at the screw rotor includes, for example, grinding with a grinding stone formed with a section corresponding to the shape of the rotor groove portion.

In ground finish for the screw rotor, a machining allowance (a polishing margin) and a contact area are different between the right and left sides of the grinding stone in a grinding stone traveling direction because the screw rotor is twisted. For this reason, force, i.e., grinding force (grinding resistance), is not evenly applied to the right and left sides of the grinding stone. Thus, deformation of a tooth-shaped sectional shape occurs at the screw rotor during grinding.

Regarding this phenomenon, JP-A-2016-14369 (Patent Document 1) describes that in a case where an inclined grinding stone for grinding a rotor of a screw compressor is moved parallel with an axial direction during rotation of the rotor to process the rotor into a predetermined rotor groove shape, a tooth-shaped sectional shape of a rotor groove portion is deformed.

In addition to this phenomenon, the form of contact between the grinding stone and the rotor groove changes every second at grinding stone input and outlet portions of the screw rotor, and for this reason, grinding force on the right and left sides of the grinding stone changes. Accordingly, the amount of deformation of the tooth-shaped sectional shape at the rotor groove portion changes. When the tooth-shaped sectional shape changes, such a change is a cause for degradation of the accuracy of the screw rotor. For this reason, Patent Document 1 describes that when the vicinity of a discharge-side end surface of the screw rotor is processed, the processing is performed with a theoretical value to which a correction value is added according to the amount of deformation of the sectional shape of the rotor groove portion due to the grinding force, and in this manner, deformation influence is cancelled out.

Moreover, Patent Document 1 also describes that a rotor rotary shaft is rotated with a theoretical value to which a correction amount is added according to the amount of rotation of the tooth-shaped sectional shape of the rotor groove portion due to the grinding force, and in this manner, influence of torsional deformation is cancelled out.

CITATION LIST

Patent Document

Patent Document 1: JP-A-2016-14369

SUMMARY OF THE INVENTION

Problems to be Solved by the Invention

As described above, Patent Document 1 describes the method in which the correction amount is, for performing ground finish, added to the theoretical value according to a lead error indicating the magnitude of deformation or torsion of the sectional shape of the screw rotor due to, e.g., a change in a torsional deformation amount due to a change in the grinding force during grinding with the grinding stone.

However, Patent Document 1 fails to describe the form of an error obtained by a measurer and the method for handling a correction amount for correction of the error.

Normally, the accuracy of the screw rotor is measured using a three-dimensional measuring instrument. The three-dimensional measuring instrument is a coordinate measuring instrument, and the error is displayed as a distance from proper measurement coordinates (a design value).

An amount necessary for correction of the groove lead error is a correction amount regarding a torsion angle. In a screw rotor grinding machine, processing is performed with the amount of movement of the grinding stone along the axis of the screw rotor and the rotation angle of the screw rotor being synchronized with each other. The lead of the screw rotor is determined by the movement amount of the grinding stone and the rotation angle of the screw rotor.

Thus, correction control data of the grinding machine necessary for correction of the lead error cannot be directly obtained from measurement results of the three-dimensional measuring instrument including the distance as the error at the axial position of the screw rotor.

Moreover, axial positions for starting, changing, and ending correction of the lead error are determined with reference to the center of the width of the grinding stone. However, an important position for measurement of the lead is an engagement position of male and female rotors called pitch circles, and for this reason, a difference in the engagement position of the male and female rotors is important for production of correction data. However, Patent Document 1 fails to consider the difference in the engagement position of the male and female rotors.

For these reasons, after ground finish by the grinding machine has been performed for the material of the screw rotor produced by, e.g., casting, a correction starting position and a correction amount for the grinding machine are experimentally determined with reference to an error between the axial position of the engagement position (a position on the pitch circle) of the male and female rotors obtained by the three-dimensional measuring instrument and the design value, and ground finish is performed again for the material of the screw rotor. Thereafter, this re-produced sample is measured. In a case where the error exceeds an acceptable value, the operation of determining the correction starting position and the correction amount for the grinding machine, performing ground finish for the material of the screw rotor, and measuring the sample is repeated again.

This conventional case employs a technique in which the cycle of experimentally determining the correction starting position and the correction amount and grinding the material of the screw rotor is repeated many times through trial and error until a value within target accuracy is obtained. Moreover, in this screw rotor processing method through trial and error, the number of trials is increased when high target accuracy is set, and therefore, it is difficult to obtain a sufficiently high accuracy value.

Further, even when production is performed once with the determined correction starting position and the determined correction amount, if replacement of, e.g., the grinding stone or a dresser influencing the grinding force is performed, the process of determining the correction starting position and the correction amount through trial and error needs to be performed again.

As described above, in the conventional ground finish method through trial and error, ground finish for the screw rotor material and measurement are repeated until the value within the target accuracy is obtained. For this reason, such a process is an inefficient process requiring time, and is a cause for interference with production.

Moreover, the correction data for the processing machine is produced through trial and error. For this reason, the prospect for the accuracy of the lead of the screw rotor obtained from the correction data determined as necessary cannot be provided before ground finish for the material of the screw rotor, and appropriateness of such accuracy cannot be evaluated.

An object of the present invention is to provide a screw rotor processing method and a screw rotor lead correction calculation device so that correction data for obtaining a screw rotor with a high-accuracy lead can be obtained from a lead error with respect to a reference lead of a screw rotor obtained by ground finish for the material of the screw rotor.

Solutions to the Problems

For accomplishing the above-described object, the present invention relates to a screw rotor processing method for correcting a lead error of a screw rotor to process the screw rotor. The method includes grinding the material of the screw rotor, measuring, as a distance, a lead error with respect to a reference lead at an axial position (a Z-direction position) of a rotor groove portion of the screw rotor produced by grinding, calculating, based on the lead error measured as the distance, a lead correction amount for correction of the lead error and a lead correction starting position as an axial position of the screw rotor for starting the lead correction, and grinding the screw rotor based on the calculated lead correction amount and the calculated lead correction starting position.

Another feature of the present invention relates to a screw rotor lead correction calculation device for obtaining correction data for correction of a lead error of a screw rotor. The screw rotor lead correction calculation device includes an initial data input section configured to input an error (δ) as a distance with respect to a reference lead at each axial position of a rotor groove portion of the screw rotor, and a processing machine input correction amount/position output section configured to compute and output, based on the error as the distance input to the initial data input section, a lead correction amount with respect to the reference lead and a lead correction starting position as an axial position for starting lead correction.

Effects of the Invention

According to the screw rotor processing method and the screw rotor lead correction calculation device of the present invention, there is an advantageous effect that the correction data for obtaining a screw rotor with a high-accuracy lead can be obtained from the lead error with respect to the reference lead of the screw rotor obtained by ground finish for the material of the screw rotor.

DESCRIPTION OF EMBODIMENTS

Figure 1:
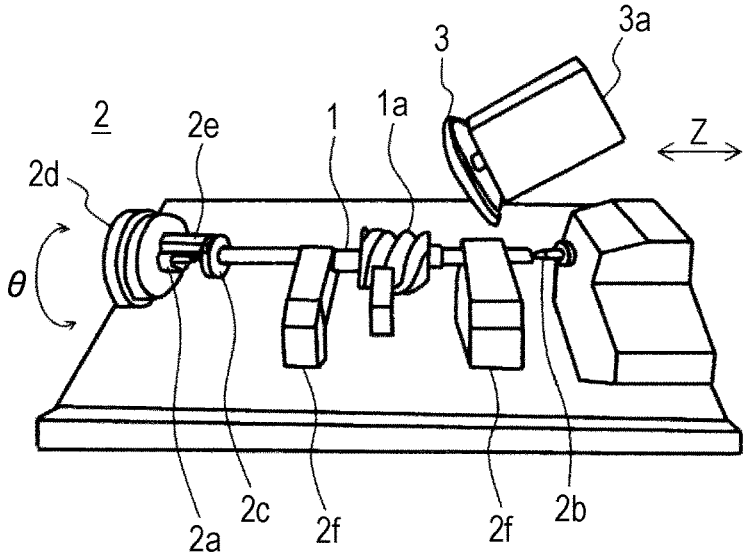
FIG. 1 is a schematic perspective view of one example of a processing machine configured to perform ground finish for a screw rotor.

Hereinafter, a specific embodiment of a screw rotor processing method and a screw rotor lead correction calculation device according to the present invention will be described with reference to the drawings. In each figure, elements with the same reference numerals are used to represent identical or equivalent elements.

First Embodiment

A first embodiment of the present invention will be described with reference to FIGS. 1 to 8.

First, one example of a processing machine configured to perform ground finish for a screw rotor will be described with reference to FIG. 1. FIG. 1 is a schematic perspective view of one example of the processing machine for screw rotor ground finish.

In FIG. 1, a processing machine 2 of a screw rotor 1 includes centers 2*a*, 2*b* configured to support both ends of the screw rotor 1, and the centers 2*a*, 2*b* are each inserted into one end and the other end of the screw rotor 1 to rotatably support the screw rotor 1.

Moreover, the processing machine 2 is configured such that a lathe dog 2*c* fixed to the screw rotor 1 and a driver (a driving plate) 2*e* fixed to a rotary mechanism 2*d* of the processing machine 2 are coupled to each other to rotate the screw rotor 1.

A reference numeral 3 indicates a grinding stone to be rotatably driven by a grinding stone driver 3*a*. The grinding stone 3 is arranged inclined with respect to the center axis of the screw rotor 1, and is formed in such a grinding stone shape that a screw rotor groove portion (hereinafter also merely referred to as a "rotor groove portion") 1*a* can be processed into a tooth groove shape at such an inclination angle. Moreover, the grinding stone 3 is a so-called form grinding stone whose outer peripheral portion is formed by a diamond dresser so that the rotor groove portion 1*a* can be ground into a final finished shape in an inclination state.

Note that for reducing deflection of the screw rotor 1 upon grinding, steady rests 2*f* configured to support the vicinity of both ends of the rotor groove portion 1*a* are provided. The steady rests 2*f* are not necessarily provided in the case of a short screw rotor 1.

For grinding the rotor groove portion 1*a* of the screw rotor 1, the screw rotor 1 is rotated by the driver 2*e* while the inclined grinding stone 3 is moved parallel with the axis of the screw rotor 1, and in this manner, the rotor groove portion 1*a* is processed.

In grinding, grinding force as force by grinding is generated, and part of the processing machine 2 such as the grinding stone 3, the screw rotor 1, the centers 2*a*, 2*b*, and the driver 2*e* performs the processing while deforming. When the grinding force is constant, a deformation amount is also constant. Thus, certain correction data is provided so that high-accuracy processing can be performed. However, when the grinding force changes, the deformation amount changes accordingly, and for this reason, a processing error becomes greater.

Figure 2:
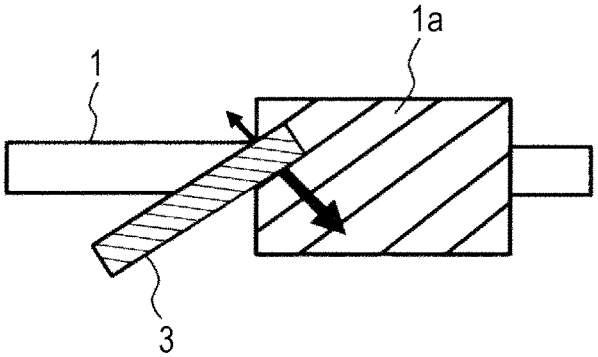
FIG. 2 is a view for describing that grinding resistance is different between the right and left sides of a grinding stone at grinding stone inlet and outlet portions when a rotor groove portion of the screw rotor is ground.

FIG. 2 is a view for describing that grinding resistance is different between the right and left sides of the grinding stone at an inlet portion and an outlet portion of the grinding stone when the rotor groove portion 1*a* of the screw rotor is ground. That is, FIG. 2 is a schematic view in a state in which the rotor groove portion 1*a* of the screw rotor 1 is about to be ground or a state in which grinding is about to end. An end portion of the rotor groove portion 1*a* of the screw rotor 1 is in a shape perpendicular to an axial direction, and therefore, the area of grinding by the grinding stone 3 contacting the rotor groove portion 1*a* is different between the right and left sides of the grinding stone.

Arrows illustrated in FIG. 2 simulatively indicate the grinding force applied to the rotor groove portion 1*a* by processing with the grinding stone 3. For starting grinding, the grinding stone 3 is brought into the state of performing the processing on one side of the grinding stone 3 before the state of FIG. 2, and such a state transitions to the state illustrated in FIG. 2. In the state of FIG. 2, force acting on one side (a side with a larger grinding area) of the grinding stone 3 is greater, and the grinding resistance increases until force acting on the right and left sides reaches a certain steady state (a state in which the grinding area is equal between the right and left sides) by advancement of the grinding stone 3. Conversely, in the state in which the grinding stone 3 is about to end grinding, the area of contact with the grinding stone 3 gradually decreases, and therefore, the force acting on the grinding stone 3 changes accordingly. A change in the force acting on the grinding stone 3 has the same meaning as a change in force acting on the rotor groove portion 1*a*.

Figure 3A:
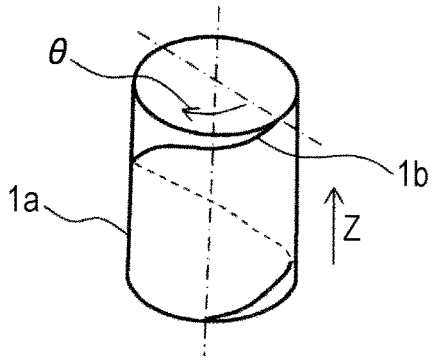
FIG. 3A is a view for describing one example of a lead shape of the screw rotor groove portion.

FIG. 3A is a view for describing one example of a lead shape of the screw rotor groove portion, the view schematically illustrating the spiral lead shape of the screw rotor groove portion 1*a*. A reference numeral 1*b* indicates a curved line of the spiral lead of the screw rotor. A relationship with a position in a Z-direction (the axial direction) on the curved line 1*b* when a rotation angle $\theta$ is $2\pi$, i.e., the distance of axial movement of one point on the curved line 1*b* by single rotation of the screw rotor, will be referred to as a "lead." Moreover, FIG. 3A illustrates curved lines of both end surfaces of the rotor groove portion 1*a* of the screw rotor 1 with the same lead. A design value of such a lead will be referred to as a reference lead.

Figure 3B:
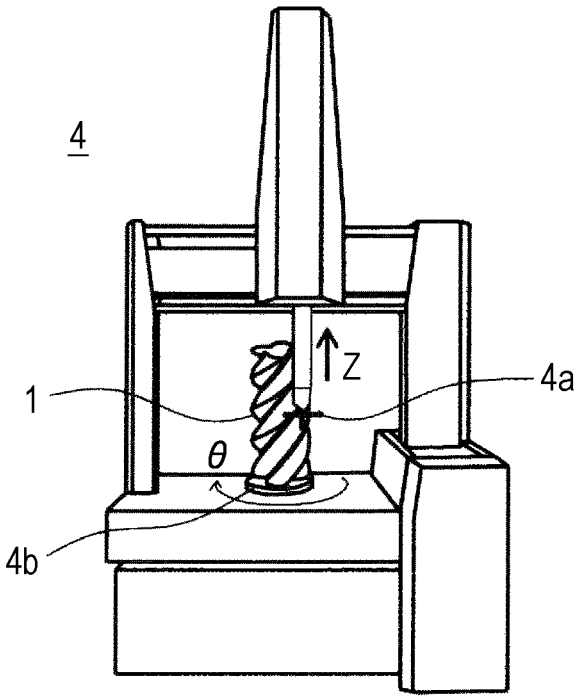
FIG. 3B is an external view of one example of a three-dimensional measuring instrument configured to measure the lead of the screw rotor groove portion.

FIG. 3B is an external view of one example of a three-dimensional measuring instrument configured to measure the lead of the screw rotor groove portion. A three-dimensional measuring instrument 4 includes a probe 4*a* and a rotary table 4*b*. The lead is measured with the screw rotor 1 being placed on the rotary table 4*b* of the three-dimensional measuring instrument 4. That is, the probe 4*a* and the rotary table 4*b* are controlled such that the probe 4*a* moves along the reference lead of the screw rotor 1. A difference (a distance) between a coordinate value of the resultant measured lead of the screw rotor and a coordinate value corresponding to the coordinate value of the resultant lead on the reference lead is output from the three-dimensional measuring instrument 4. The difference between the coordinate value of the measured lead and the coordinate value of the reference lead is taken as an error (a lead error) of the lead of the screw rotor 1.

Note that such a three-dimensional measuring instrument is not necessarily used, and the lead of the screw rotor 1 may be measured using a three-dimensional measuring instrument including no rotary table or a three-dimensional measuring instrument employing the technique of touching measurement points by a probe 4*a* of the three-dimensional measuring instrument one by one. Alternatively, during rotation of the screw rotor 1, the lead may be measured with a displacement gauge such as an electric micrometer.

Figure 4:
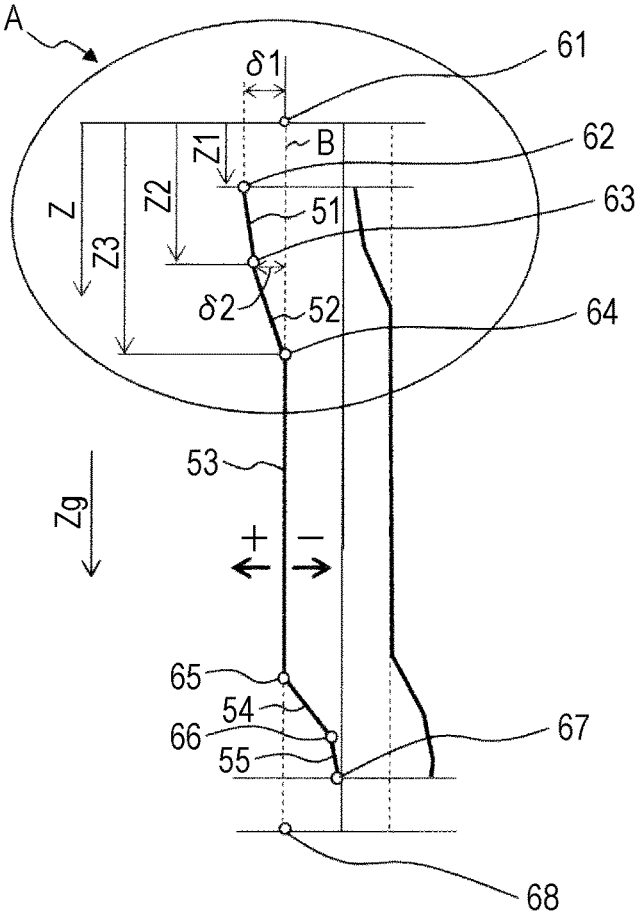
FIG. 4 is a diagrammatic view for describing one example of a lead error output from the three-dimensional measuring instrument.

FIG. 4 is a diagrammatic view for describing one example of the lead error output from the three-dimensional measuring instrument, and illustrates one example of measurement results output from the three-dimensional measuring instrument 4 described with reference to FIG. 3B. That is, FIG. 4 is a view of a dashed line B indicating the reference lead as an ideal curved line for the screw rotor 1 in the Z-direction (the axial direction) and line segments 51 to 55 indicating the measured lead of the screw rotor 1. FIG. 4 illustrates the error of the lead of the screw rotor 1 measured for each position (Z1, Z2, Z3, . . . ) of the reference lead in the Z-direction. These measurement results indicating the error of the measured lead with respect to the reference lead are computed in the three-dimensional measuring instrument 4, and are generally output with the results being printed on paper.

In FIG. 4, reference numerals 62 to 67 are measurement points at which the lead of the screw rotor has been actually measured. FIG. 4 illustrates one example of the lead error with respect to the reference lead at each measurement point. The position of measurement of the lead of the rotor groove portion 1*a* of the screw rotor 1 is on each of the right and left sides of the rotor groove portion 1*a*, and therefore, FIG. 4 illustrates two measured leads. However, these right and left leads are equal to each other, and therefore, description below will be made using the values of the lead measurement points 62 to 67 on one side.

A reference numeral 61 corresponds to a starting point of movement of the moving grinding stone 3, and a reference numeral 68 corresponds to an end point. In a case where there is no lead error in the screw rotor targeted for measurement, the lead measurement values for the screw rotor are displayed on the dashed line B (the reference lead) connecting the movement starting point 61 and the end point 68 to each other.

However, in the screw rotor 1 processed by the grinding machine 2 (see FIG. 1), the error with respect to the dashed line B is great at the measurement point 62 (the position Z1 in the Z-direction) as the inlet of the rotor groove portion 1*a* of the screw rotor 1 in a traveling direction Zg of the grinding stone 3, and thereafter, gradually decreases in the traveling direction Zg of the grinding stone 3 as indicated by the line segments 51, 52.

After the measurement point 64, a coincidence with the reference lead is substantially shown. However, in the vicinity of the outlet (the outlet of the rotor groove portion) of the grinding stone 3, the error increases again, and increases until the measurement point 67 at the outlet of the rotor groove portion. Note that the pattern of the lead error of the screw rotor illustrated in FIG. 4 is one example.

As described above, the measurement result of the lead error in the screw rotor is output as the error with respect to the dashed line B (the reference lead) at each position (Z1, Z2, Z3, . . . ) in the Z-direction, i.e., the distance to the dashed line B. For example, as illustrated in FIG. 4, the distance of separation of the measurement point 62 from the dashed line B is taken as an error δ1. The error as the distance at the measurement point 63 is δ2, and the error as the distance at the measurement point 63 is 0.

Note that the biggest factor for the error with respect to the dashed line B is a change in the grinding resistance as described with reference to FIG. 2.

In the grinding machine 2 illustrated in FIG. 1, grinding is performed by controlling the traveling position of the grinding stone 3 in the Z-direction and the position (the rotation angle θ) of the rotor groove portion 1*a* of the screw rotor 1 in a rotation direction. However, in the diagrammatic view illustrated in FIG. 4, the amount of adjustment by adjusting the control in the grinding machine 2 for eliminating the error is not taken into consideration.

In the present embodiment, the adjustment amount (a lead correction amount) in correction for eliminating the error is, in the grinding machine 2, obtained by the later-described technique, and the grinding machine 2 is controlled to perform grinding with the adjustment amount.

Figure 5A:
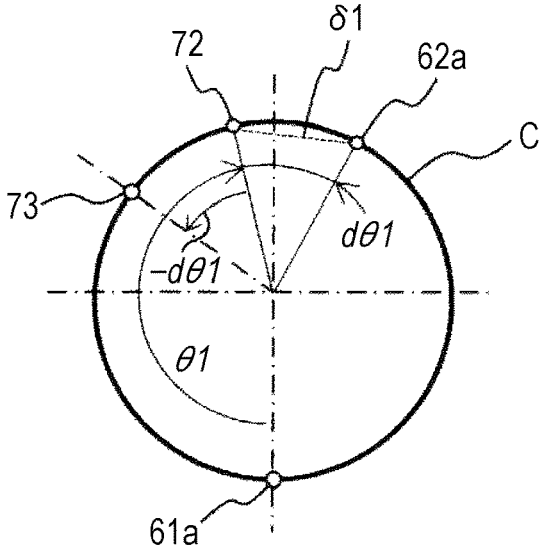
FIG. 5A is a diagrammatic view for describing an ideal rotation angle θ1 corresponding to a position Z1 in a Z-axis direction illustrated in FIG. 4 and a rotation angle dθ1 corresponding to an error δ1 with respect to a reference lead, on a reference circle used for measurement.
Figure 5B:
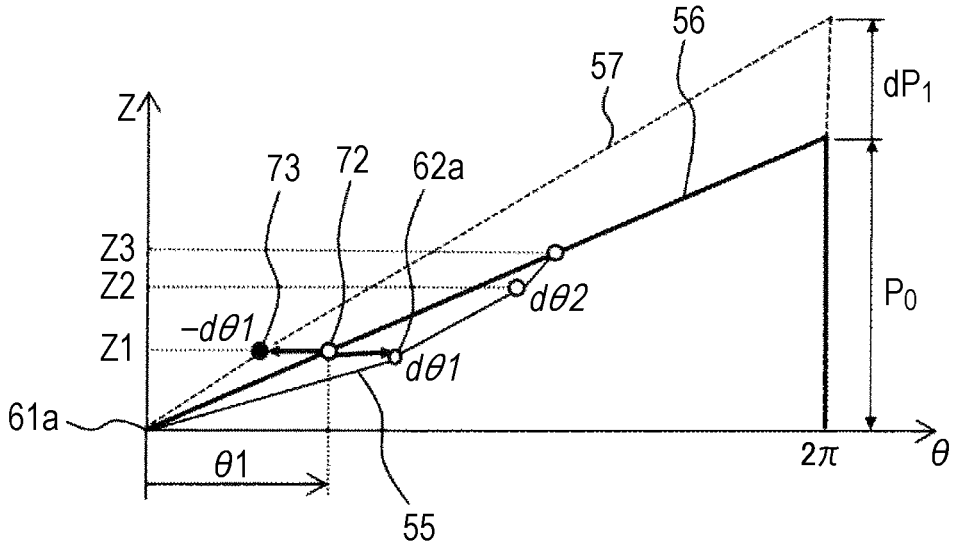
FIG. 5B is a diagrammatic view for describing the technique of obtaining a correction lead for correction of the error with respect to the reference lead, the diagrammatic view being for describing the method for obtaining a correction lead for a measurement point 62 illustrated in FIG. 4.
Figure 5C:
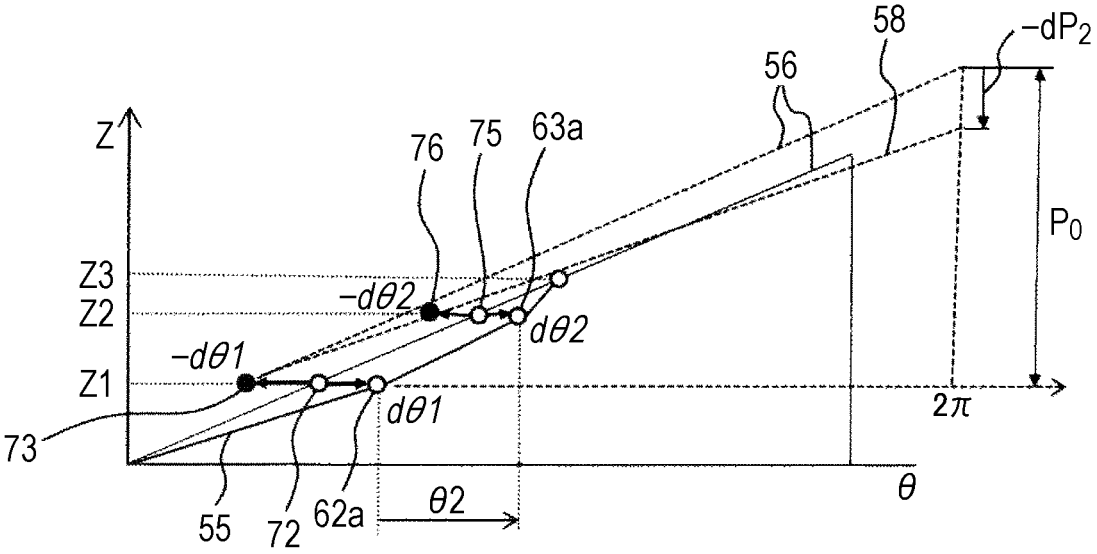
FIG. 5C is a diagrammatic view for describing the technique of obtaining the correction lead for correction of the error with respect to the reference lead, the diagrammatic view being for describing the method for obtaining a correction lead for a measurement point 63 illustrated in FIG. 4.

FIGS. 5A to 5C are diagrammatic views for describing one example of the technique of correcting the lead error of the screw rotor, the views illustrating the concepts for correcting the lead having the error measured at each of the measurement points 62 to 64 in a portion A of FIG. 4.

In FIG. 5A, an ideal rotation angle corresponding to the position Z1 in the Z-direction as illustrated in FIG. 4 on a reference circle (a pitch circle) C used for measurement is θ1, and corresponds to a point 72 on the reference circle (a pitch circle) C. The origin of the rotation angle θ in FIG. 5A is at a Z-direction position (Z=0) corresponding to the point 61 illustrated in FIG. 4, and corresponds to a point 61*a* on the reference circle C.

The axial position Z1 of the measurement point 62 illustrated in FIG. 4 can be converted into the point 72 on the reference circle C in FIG. 5A. The measurement point 62 is a point including the error δ1 indicated by the distance from an ideal point (the reference lead), but the error δ1 can be converted into an angle dθ1 on the reference circle C in FIG. 5A. That is, the angle dθ1 corresponding to the distance as the error δ1 illustrated in FIG. 4 can be obtained based on a relationship between the length of the distance at the position Z1 illustrated in FIG. 4 and the rotation angle θ1 illustrated on the reference arithmetic device C of FIG. 5 ($d\theta 1=\theta 1\cdot\delta 1/Z1$). Thus, the measurement point 62 can be, in FIG. 5A, converted into a point 62*a* advanced from the origin 61*a* of the rotation angle θ by "θ1+dθ1."

FIG. 5B is a diagrammatic view of a relationship between the rotation angle θ and the Z-direction position according to a line 56 indicating a reference lead $P_0$ and a line 57 indicating a corrected lead ($P_0+dP_1$) (a correction lead) including a lead correction amount $dP_1$. The point 62*a* corresponding to the measurement point 62 and advanced from the origin 61*a* of the rotation angle illustrated in FIG. 5A by "θ1+dθ1" is a point having an angle error of dθ1 from the ideal point 72 on the line 56 indicating the reference lead. The point 62*a* (the measurement point 62) is a point including the error δ1 caused due to unbalance grinding force applied from the grinding stone 3.

Thus, for correcting the error δ1, the locus of passage of the grinding stone 3 is set such that the grinding stone 3 passes through a correction point 73 taking a rotation angle −dθ1 obtained by reversing (inverting) the sign of the rotation angle dθ1 corresponding to the error δ1 as a difference from the rotation angle θ1 corresponding to the ideal point 72 on the line 56 indicating the reference lead. In this manner, correction is made by the rotation angle dθ1 corresponding to the error δ1 due to unbalance grinding force, and therefore, the grinding stone 3 can perform the processing at the ideal point 72 on the reference lead.

Next, elimination of the rotation angle dθ1 corresponding to the error δ1 by the above-described technique will be described in more detail with reference to FIGS. 5A and 5B.

As illustrated in FIG. 5B, a line passing through the origin 61*a* and the correction point 73 corresponding to a rotation angle of "θ1−dθ1" is the line 57 indicating the correction lead, and the magnitude of the correction lead is "$P_0+dP_1$." A parameter $dP_1$ is a lead correction amount.

The correction lead ($P_0+dP_1$) is data inputtable to the grinding machine 2 illustrated in FIG. 1. Using the correction lead, the position of the screw rotor 1 corresponding to the measurement point 62 (the position Z1) is ground, and therefore, the point 62*a* (the measurement point 62) including the rotation angle dθ1 corresponding to the error δ1 can be adjusted to the ideal point 72 on the reference lead 54. Thus, the measurement point 62 illustrated in FIG. 4 includes the error δ1 as the distance, but the error δ1 can be eliminated.

Subsequently, a similar technique may be, as illustrated in FIG. 5C, applied to other portions with a change in a lead obtained by measurement for a sample subjected to ground finish, thereby obtaining a correction lead. These portions may be ground with this correction lead. Specifically, the following technique is performed.

In FIG. 5C, a point 63*a* is a point including a rotation angle d$\theta$2 corresponding to an error $\delta$2 of the measurement point 63 illustrated in FIG. 4, and the method for obtaining a correction lead for correction of the error at the point 63*a* (the measurement point 63) will be described.

At the Z-direction position Z2 illustrated in FIGS. 4 and 5C, the grinding stone 3 may be, for correcting the point 63*a* (the measurement point 63) including the rotation angle d$\theta$2 corresponding to the error $\delta$2, controlled to process a tooth groove along a line 58 indicating a corrected correction lead ($P_0$–$dP_2$) such that a correction point 76 corrected by –d$\theta$2 with respect to the line 56 as a solid line indicating the reference lead is processed.

In an example of FIG. 5C, the position of the screw rotor 1 corresponding to the measurement point 63 (the position Z2) is ground with the correction lead smaller than the dashed line 56 by $dP_2$ passing through the correction point 73 and indicating the reference lead $P_0$, and therefore, the screw rotor having the lead for which the error $\delta$2 has been corrected can be obtained. The line 58 indicating the correction lead is a line passing through the previous correction point 73 and the current correction point 76. Note that $dP_2$ is a lead correction amount with respect to the reference lead 56.

For the processing, a correction lead for a position at a more-advanced angle than the measurement point 63 needs to be obtained. However, the correction lead is merely obtained by a technique similar to that described above and is similarly processed, and therefore, subsequent description will be omitted.

In description of correction of the lead error with reference to FIG. 4 and FIGS. 5A to 5C, the pattern in which the lead changes in two stages or three stages has been described. However, such a lead error pattern is one example. There are patterns with less or more stages than the above-described example, but lead correction can be similarly made by application of the above-described technique.

When the rotation angle to be corrected is d$\theta$ and the reference lead is $P_0$, a lead correction amount dP ($dP_1$, $dP_2$, . . . ) can be obtained by (Expression 1) below. That is, when a rotation angle to be corrected at a position with a rotation angle $\theta_i$ on the reference lead is $d\theta_i$, a distance at a position in the Z-direction as the axial direction is $Z_i$, the lead correction amount is dP, and the reference lead is $P_0$, the lead correction amount dP can be obtained by the following expression.

[Expression 1]

$$dP = \frac{2\pi(Z_{i+1} - Z_i)}{(\theta_{i+1} + d\theta_{i+1}) - (\theta_i + d\theta_i)} - P_0 \quad \text{(Expression 1)}$$
$$i = 0, 1, 2, \ldots$$

Note that an index i indicates the order of the measurement point for which the lead error with respect to the reference lead at the Z-direction position of the rotor groove portion has been measured, and "i=0" corresponds to the origin of the rotation angle or the Z-direction position. Moreover, "i=1" corresponds to the position of Z1 or the position of $\theta$1.

Figure 6:
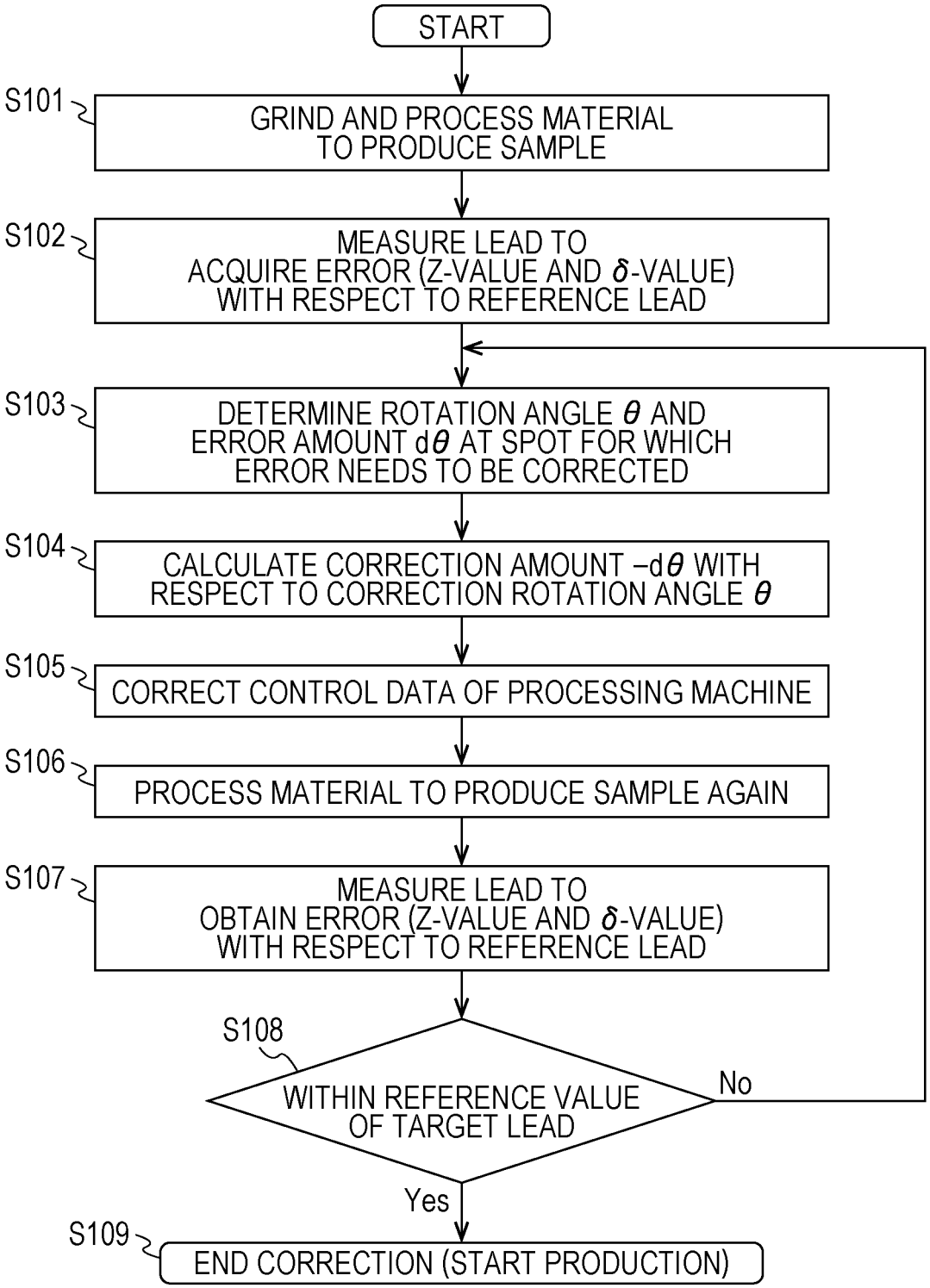
FIG. 6 is a flowchart for describing the method for calculating data for correction of the lead error of the screw rotor.

The procedure of performing the screw rotor processing method for processing the screw rotor with the corrected lead as described above will be described below with reference to FIG. 6. FIG. 6 is a flowchart for describing one example of the method for calculating data for correction of the lead error of the screw rotor.

First, at a step S101, the grinding machine 2 illustrated in FIG. 1 is used to grind the material of the screw rotor to produce a sample. Next, at a step S102, the lead of the produced sample is measured with, e.g., the three-dimensional measuring instrument illustrated in FIG. 3B, the error $\delta$ with respect to the reference lead in the Z-direction of the rotor groove is measured, and the error ($\delta$1, $\delta$2, . . . ) with respect to the reference lead at each position (Z1, Z2, . . . ) in the Z-direction is acquired.

At a step S103, the rotation angle $\theta$ at a spot for which the error needs to be corrected and an error amount (the rotation angle d$\theta$ corresponding to the error $\delta$) at such a spot are determined using the technique of correcting the lead error of the screw rotor as described with reference to FIG. 4 and FIGS. 5A to 5C.

At a step S104, the correction amount "–d$\theta$" with respect to the correction rotation angle (the rotation angle at the spot for which the error needs to be corrected) $\theta$ is obtained based on determination results, which are obtained at the step S103, of the rotation angle $\theta$ and the error amount d$\theta$ at the spot for which the error needs to be corrected, the correction amount being to be input to the grinding machine 2.

At a step S105, the correction lead and the lead correction amount are computed based on the correction amount "–d$\theta$" obtained at the step S104, and control data (the lead correction amount and a lead correction position) of the grinding machine 2 is corrected. By the processing machine 2 to which the correction data has been input as described above, the material of the screw rotor is newly ground, and in this manner, a second sample is produced (a step S106). Next, at a step S107, lead measurement is performed for the produced second sample, and processing similar to that of the step S102 is performed.

At a step S108, it is determined whether or not the second sample has a value within a reference value of a target lead with respect to the reference lead. When the second sample has the value within the reference value of the target lead, production of the sample by the processing machine 2 ends. In a case where the second sample does not reach the reference value of the target lead, the processing returns to the step S103 again, and operation at the steps S103 to S108 is performed based on the error (a Z-value and a $\delta$-value) with respect to the reference lead of the previously-produced sample. Similar operation is repeated until a sample having a value within the reference value of the target lead is produced.

When the produced sample reaches the reference value of the target lead, the processing proceeds to a step S109, and production of the screw rotor begins with data on production of the sample having the value within the reference value of the target lead.

Figure 7:
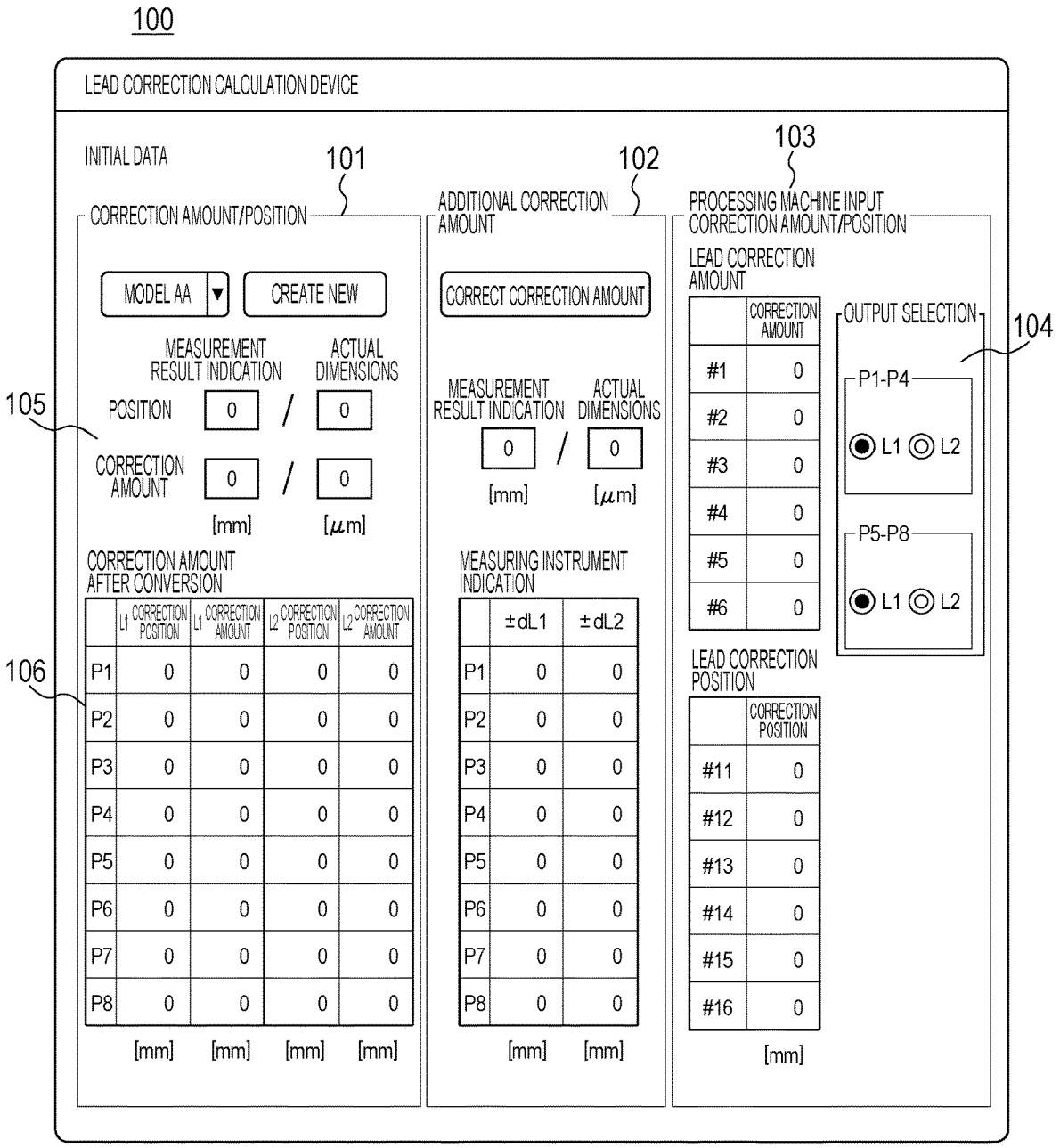
FIG. 7 is a view of one example of a screen of a lead correction calculation device in the present invention.

Next, a lead correction calculation device configured to calculate the above-described data for correction of the lead error of the screw rotor will be described with reference to FIG. 7. A lead correction calculation device 100 illustrated in FIG. 7 includes, for example, a personal computer (PC), and software (a calculation program) for lead correction calculation is installed in the lead correction calculation device 100. FIG. 7 illustrates one example of a display screen (a screen displayed on, e.g., a monitor of the PC) of the lead correction calculation device 100.

The lead correction calculation device 100 includes an initial data input section 101 configured to input initial data such as a measurement value measured by the above-described three-dimensional measuring instrument 4, a correction amount addition section 102 configured to additionally input the correction amount for the lead error in a case where the measured lead is not within the reference value of the target lead, and a processing machine input correction amount/position output section 103 configured to compute and output data, such as the lead correction amount and a lead correction starting position, to be input to the control section (not shown) of the grinding machine 2 illustrated in FIG. 1.

The initial data input section 101 is configured such that a model is selected by, e.g., pull-down operation to invoke base data in the calculation program of the lead correction calculation device 100, the base data being input and stored in advance based on design data such as the reference lead and groove length of such a model.

Note that the measurement results (the view of the measurement results printed on the paper as illustrated in FIG. 4) output from the three-dimensional measuring instrument 4 illustrated in FIG. 3B are displayed with data, i.e., scales, for performing scale computation for converting the error of the illustrated measured lead with respect to the reference lead and the distance at, e.g., the Z-direction position into actual dimensions. A scale input section 105 configured to input the scales is also provided at the initial data input section 101. A "POSITION" in the scale input section 105 is the scale for the position in the Z-direction, and a "CORRECTION AMOUNT" is the scale for the lead error.

Moreover, the initial data input section 101 includes a lead measurement value input section 106 configured to input the Z-direction position for which the lead needs to be corrected and the lead correction amount (corresponding to the error δ of the measured lead with respect to the reference lead) at such a position. In this example, lead measurement data for eight measurement points P1 to P8 can be input. For example, measurement data corresponding to the measurement points 61 to 68 illustrated in FIG. 4 is input for the measurement points P1 to P8. Moreover, P1 to P4 correspond to a grinding starting section, and P5 to P8 correspond to a grinding end section.

Further, it is configured such that not only data on the measured lead of one surface (L1) of the rotor groove portion 1*b* but also data on the measured lead of the other surface (L2) can be input.

The correction amount addition section 102 is a section configured to input data for correcting the initial data of the initial data input section 101 in a case where the second sample does not have the value within the reference value of the target lead at the step S108 of FIG. 6 (in the case of No).

The processing machine input correction amount/position output section 103 is an area for calculating and outputting (displaying) the data to be input to the grinding machine 2 illustrated in FIG. 1. Fields #1 to #3 of the lead correction amount output the lead correction amounts for the grinding starting section (corresponding to the measurement points 62 to 64), and fields #4 to #6 output the lead correction amount corresponding to the grinding end section (corresponding to the measurement points 65 to 67).

The lead correction amount at each position in the Z-direction can be calculated using (Expression 1) described above based on the theory described with reference to FIGS. 5A to 5C.

Moreover, #11 to #13 display the positions (the positions in the Z-direction) to which the lead correction amounts of #1 to #3 corresponding to the grinding starting section are provided. Further, #14 to #16 display the positions to which the lead correction amounts of #4 to #6 corresponding to the grinding end section are provided.

In addition, a selection button 104 configured to instruct output selection is provided so that it can be selected on which surface of the rotor groove portion 1*b* data is used to calculate the lead correction amount and the corresponding lead correction position.

When the control data of the grinding machine 2 is corrected using the above-described calculation results, i.e., the lead correction amounts #1 to #6 and the values of the lead correction positions #11 to #16 to which the lead correction amounts are to be provided, the grinding machine can perform grinding with the control data taking lead correction into consideration.

Using the above-described screw rotor processing method or the above-described screw rotor lead correction calculation device, there is an advantageous effect that a screw rotor with high lead accuracy can be easily obtained.

Note that the screen of the lead correction calculation device 100 illustrated in FIG. 7 is one example, and the number of measurement data inputs and the number of data pieces of the output calculation results are not limited to those illustrated in FIG. 7. These numbers may be smaller or greater numbers, but with greater numbers, a higher-accuracy screw rotor can be obtained.

As long as the initial data input section 101 configured to input the measurement data and the processing machine input correction amount/position output section 103 configured to output the correction data for correction for the grinding machine 2 are provided on the screen, the minimum functions can be fulfilled. Thus, the correction amount addition section 102 may be omitted.

According to the lead correction calculation device 100 illustrated in FIG. 7, the measurement values obtained from the three-dimensional measuring instrument 4 are merely input to the initial data input section 101 so that the data for correction control of the grinding machine 2 can be easily obtained. Thus, the lead correction calculation device 100 can be easily used at a screw rotor production plant without the need for a special technique, and therefore, a high-accuracy screw rotor can be efficiently produced.

Note that the example where the lead error is measured from the measurement data obtained from the three-dimensional measuring instrument 4 and the numerical values are artificially input to the initial data input section 101 has been described. However, the measurement data may be automatically input to the lead correction calculation device 100 by cooperation with software of the three-dimensional measuring instrument 4. Alternatively, it may be configured such that the correction data (the lead correction amount and the lead correction position) output from the processing machine input correction amount/position output section 103 of the lead correction calculation device 100 is automatically transferred to the grinding machine 2 via an interface (not shown) of the lead correction calculation device 100 and is automatically input to a control device of the grinding machine 2. Alternatively, a technique may be employed, in which the obtained correction data is transferred to the grinding machine 2 via a memory medium such as a flash memory.

In a case where input and output of the correction data are automated as described above, the initial data input section 101, the correction amount addition section 102, the processing machine input correction amount/position output section 103, etc. are not necessarily displayed on the screen configuration illustrated in FIG. 7, and a state such as "measurement data is being input" or "correction data is being output" may be displayed instead. However, a display function is preferably provided so that the input data and the output data illustrated in FIG. 7 can be checked by, e.g., a selection button.

Figure 8:
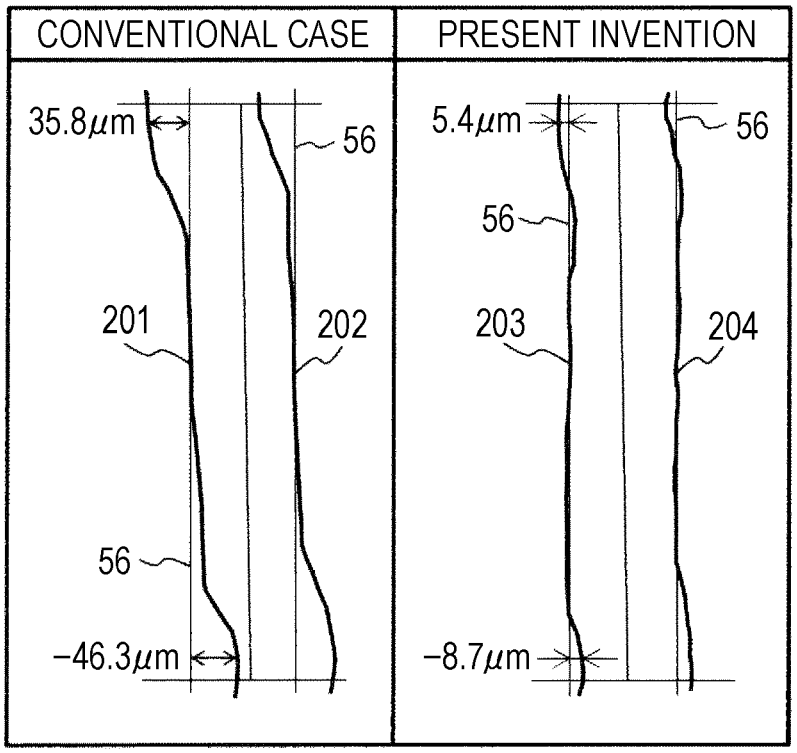
FIG. 8 is a view for describing comparison of the screw rotor produced by application of the present invention with a screw rotor produced by a conventional processing method.

FIG. 8 is a view for describing comparison of the screw rotor produced by application of the present invention with a screw rotor produced by a conventional processing method.

In FIG. 8, a left field is one example of lead measurement results of the screw rotor produced by the conventional technique, the screw rotor having been ground with a lead correction amount obtained through trial and error. Reference numerals 201, 202 indicate lines (lead measurement lines) indicating measured leads at right and left tooth surfaces of a rotor groove portion, and an error from a line 54 indicating a reference lead is indicated in terms of a distance. The lines 201, 202 show measurement results obtained as in the measurement results described with reference to FIG. 4.

In the screw rotor produced by the conventional technique, a maximum lead error of 46.3 μm is caused at a grinding stone outlet portion (the lower side as viewed in the figure). Moreover, at a grinding stone inlet portion (the upper side as viewed in the figure), a maximum lead error of 35.8 μm is caused.

Based on these measurement results, necessary data was input to the initial data input section 101 on the screen of the lead correction calculation device 100 illustrated in FIG. 7. L1 was selected as the output selection button 104, and data obtained from the lead measurement line 201 of the lead measurement lines 201, 202 illustrated in FIG. 8 was selected as a processing machine input correction amount/position.

The lead correction amount and the lead correction position displayed as a result on the screen were used and were reflected on the control data of the grinding machine 2, and the material of the screw rotor was ground to obtain the screw rotor. The lead measurement results of the resultant screw rotor are lead measurement lines 203, 204 illustrated in a right field of FIG. 8.

As illustrated in FIG. 8, the screw rotor produced by application of the present invention can reduce the lead error by about 80%, and can show significant accuracy improvement.

According to the present embodiment described above, the correction data to be input to the grinding machine 2 can be, upon processing of the screw rotor, accurately obtained based on the theory by means of the measurement results obtained from the position Z in the Z-direction (the axial direction) and the error (the lead error) in the direction perpendicular to the tooth surface with respect to the reference lead. Thus, the error between the inlet portion and the outlet portion for the grinding stone 3 in grinding of the screw rotor material can be reduced.

The initial data input section 101 configured to input the error to the screen of the lead correction calculation device 100 and the processing machine input correction amount/position output section 103 are provided. Thus, upon processing of the screw rotor, the correction data to be provided to the grinding machine can be easily obtained.

The correction data output from the lead correction calculation device 100 is input to the grinding machine 2 so that a screw rotor with a high-accuracy lead can be obtained. Thus, use of this high-accuracy screw rotor can easily provide a screw compressor with a less leakage loss of compressed gas and a high compression efficiency.

Note that the present invention is not limited to the above-described embodiment, and includes various modifications. Moreover, the above-described embodiment has been described in detail for the sake of clear description of the present invention, and the present invention is not limited to one including all configurations described above.

DESCRIPTION OF REFERENCE SIGNS

1: screw rotor
1*a*: screw rotor groove portion (rotor groove portion)
1*b*: curved line indicating lead
2: grinding machine
2*a*, 2*b*: center
2*c*: lathe dog
2*d*: rotary mechanism
2*e*: driver (driving plate)
2*f*: steady rest
3: grinding stone
3*a*: grinding stone driver
4: three-dimensional measuring instrument
4*a*: probe
4*b*: rotary table
51 to 55: line segment connecting measurement points
B, 56: line indicating reference lead
57, 58: line indicating correction lead
61: starting point of movement of grinding stone
61*a*: origin of rotation angle
62 to 67: measurement point
68: end point of grinding stone
62*a*, 63*a*: point
72: ideal point corresponding to measurement point 62 on reference lead
73: correction point (correction rotation angle −dθ1) for correction of lead error at measurement point 62
75: ideal point corresponding to measurement point 63 on reference lead
76: correction point (correction rotation angle −dθ2) for correction of lead error at measurement point 63
100: lead correction calculation device
101: initial data input section
102: correction amount addition section
103: processing machine input correction amount/position output section
104: selection button
105: scale input section
106: lead measurement value input section
201, 202: lead measurement line of conventional screw rotor
203, 204: lead measurement line of screw rotor ground by application of present invention
θ: rotation angle
δ, δ1: error (lead error)
dθ1: rotation angle corresponding to error δ1
dθθ2: rotation angle corresponding to error δ2
P0: reference lead
dP1, dP2: lead correction amount

The invention claimed is:

1. A screw rotor processing method for correcting a lead error of a screw rotor to process the screw rotor, comprising:

grinding a material of the screw rotor;

measuring, as a distance, the lead error with respect to a reference lead at an axial position of a rotor groove portion of the screw rotor produced by grinding;

wherein a lead correction amount for correction of the lead error and a lead correction starting position as an axial position of the screw rotor for starting the lead correction are calculated based on the lead error measured as the distance, including obtaining a rotation angle θ on the reference lead at the axial position of the rotor groove portion and a rotation angle dθ corresponding to a lead error at the position with the rotation angle θ, obtaining a correction point, by means of a rotation angle −dθ obtained by inverting a sign of the rotation angle dθ corresponding to the lead error, as a difference from the rotation angle θ, and obtaining the lead correction amount from a correction lead passing through the correction point and the lead correction starting position from the rotation angle θ; and grinding the screw rotor based on the calculated lead correction amount and the calculated lead correction starting position.

2. The screw rotor processing method according to claim 1, wherein the material of the screw rotor is ground by a grinding machine having a grinding stone, the lead correction amount and the lead correction starting position are calculated as a lead correction amount with respect to the reference lead at each axial position of the rotor groove portion of the screw rotor and a lead correction starting position for starting the lead correction, and data on the calculated lead correction amount and the calculated lead correction starting position is provided to the grinding machine to grind the material of the screw rotor.

3. The screw rotor processing method according to claim 2, wherein the lead correction starting position is determined by a position at which the grinding stone of the grinding machine contacts on the screw rotor.

4. The screw rotor processing method according to claim 1, wherein when a rotation angle to be corrected at a position with a rotation angle $\theta_i$ on the reference lead is $d\theta_i$, a distance at a position in a Z-direction as an axial direction is $Z_i$, the lead correction amount is dP, and the reference lead is $P_0$, the lead correction amount dP is obtained by the following equation (Expression 1):

[Expression 1]

$$dP = \frac{2\pi(Z_{i+1} - Z_i)}{(\theta_{i+1} + d\theta_{i+1}) - (\theta_i + d\theta_i)} - P_0 \quad \text{(Expression 1)}$$

$$i = 0, 1, 2, \ldots ,$$

where an index i indicates an order of a measurement point at which the lead error with respect to the reference lead at the Z-direction position of the rotor groove portion has been measured, and "i=0" corresponds to an origin of the rotation angle or the Z-direction position.

5. The screw rotor processing method according to claim 1, wherein the lead correction amount and the lead correction starting position are calculated using measurement data on a lead error of one of two surfaces forming a groove of the screw rotor.

* * * * *